US005414216A

United States Patent [19]

Swift et al.

[11] Patent Number: 5,414,216

[45] Date of Patent: May 9, 1995

[54] ELECTROSTATOGRAPHIC REPRODUCING MACHINE RESISTIVE CARBON FIBER WIRE

[75] Inventors: Joseph A. Swift, Union Hill; Stanley J. Wallace, Victor; Wilbur M. Peck, Rochester, all of N.Y.

[73] Assignee: Xerox Corporation, Stamford, Conn.

[21] Appl. No.: 134,328

[22] Filed: Oct. 12, 1993

[51] Int. Cl.[6] ..... H01B 1/04; H01B 7/04

[52] U.S. Cl. ..... 174/124 R; 174/110 R; 174/119 R; 174/257; 338/214; 428/367

[58] Field of Search ..... 174/124 R, 126.2, 110 R, 174/119 R, 257; 428/364, 367; 338/214, 66

[56] References Cited

U.S. PATENT DOCUMENTS

| | | | |
|---|---|---|---|
| 3,757,164 | 9/1973 | Binkowski | 317/2 R |
| 4,336,565 | 6/1982 | Murray et al. | 361/225 |
| 4,369,423 | 1/1983 | Holtzberg | 338/66 |
| 4,553,191 | 11/1985 | Franks, Jr. et al. | 361/212 |
| 4,576,827 | 3/1986 | Hastings et al. | 427/27 |
| 4,739,935 | 4/1988 | Hastings et al. | 239/690 |
| 4,748,436 | 5/1988 | Kanamori et al. | 338/214 |
| 4,761,709 | 8/1988 | Ewing et al. | 361/225 |
| 4,822,950 | 4/1989 | Schmitt | 174/36 |
| 4,841,099 | 6/1989 | Epstein et al. | 174/257 |
| 4,972,046 | 11/1990 | van der Heide | 174/126 |
| 4,998,090 | 3/1991 | Park | 338/214 |
| 5,139,862 | 8/1992 | Swift et al. | 428/294 |
| 5,177,529 | 1/1993 | Schroll et al. | 355/200 |
| 5,250,756 | 10/1993 | Swift et al. | 174/119 R |
| 5,270,106 | 12/1993 | Orlowski et al. | 174/126.2 |
| 5,281,771 | 1/1994 | Swift et al. | 174/262 |

*Primary Examiner*—Morris H. Nimmo

*Attorney, Agent, or Firm*—Fay, Sharpe, Beall, Fagan, Minnich & McKee

[57] ABSTRACT

An electrostatographic reproduction machine wherein at least a portion of the wiring is formed from partially carbonized polyacrylonitrile filaments having a resistivity of between $1\times10^2$ and $1\times10^{10}$ ohm-cm. Preferably, the interconnects from the power source to the corona generating means are partially carbonized polyarylonitrile wires.

21 Claims, 2 Drawing Sheets

ELECTROSTATOGRAPHIC REPRODUCING MACHINE RESISTIVE CARBON FIBER WIRE

BACKGROUND OF THE INVENTION

1. Field of the Invention

This invention relates to a wire for use in a electrostatographic reproduction machine. Particularly, this invention relates to a high resistance partially carbonized polyacrylonitrile (PAN) fiber cored wire connecting a power source and the electrostatic field generating means of a xerographic machine.

The wire of the invention is particularly well suited to be used as a replacement to the traditional metal wire currently employed in xerographic machinery. Throughout the specification, numerous references will be made to the use of partially carbonized polyacrylonitrile fiber wires as electrical conductors between a power source and a corona generating device. However, it should be realized that the wire of the invention may have many electrical interconnect applications in a xerographic machine.

2. Description of the Art

In xerographic machinery, such as copiers and printers, there are several components requiring electrical connection to a power source. For example, the electrostatic field (corona) generating devices require a very high voltage supply.

The corona deposits a uniform electrostatic charge on an imaging surface. The charge is subsequently selectively dissipated by exposure to an information containing image to form a latent electrostatic image. The latent electrostatic image may then be developed and the developed image transferred to a support surface to form a final copy of the original document.

In addition to precharging the imaging surface of a xerographic system prior to exposure, electrostatic field generating devices are used to perform a variety of other functions in the xerographic process. For example, a corona is used in tacking and detacking a paper to the imaging member and to condition the imaging surface prior, during, and after the deposition of toner.

Frequently, the electrostatic field generating device is a corotron, scorotron or dicorotron. In commercial use, the various types of corona generating devices require a high voltage of 5,000 to 8,000 volts to produce a corona spray which imparts the electrostatic charge to the surface of a photoreceptor. Accordingly, each corotron, scorotron and dicorotron require an electrical connection to a power source. In addition, the connection generally includes a means to limit current, and the wire connection generally includes a resistor. At times, this has proven to be an expensive and unreliable component in xerographic equipment. Particularly, a resistor molded into the electrical connection often forms the weakest link in the connection as a consequence of molding operation rigors.

Metallic conductors create other problems in xerographic machinery. For example, the use of a metallic electrical conductor between power source and corona generating means results in a great deal of radio frequency (RF) noise. This noise often interferes with other electronic components in and/or around the xerographic machinery.

Other industries have encountered the difficulty of noise associated with typical metallic conductors. For example, U.S. Pat. No. 4,369,423 discloses a graphitized polyacrylonitrile filament for use as an ignition cable.

However, the cable has a typical conductivity of 65 ohms per linear foot at room temperature. Accordingly, this cable is not appropriate for the current xerographic machinery application which requires a higher resistivity.

The xerographic art has, on occasion, recognized the utility of a resistive non-metallic fiber. For example, U.S. Pat. No. 4,553,191 discloses a static eliminator device having a brush-like configuration of carbonized polyacrylonitrile fibers having electrical resistivity from about $2\times10^3$ ohms-cm to about $1\times10^6$ ohms-cm. However, this patent does not teach a carbonized polyacrylonitrile fiber as a wiring component or as an electrical interconnector to replace discrete resistors.

U.S. Pat. No. 4,761,709 teaches a contact brush for charging a photoconductive insulating layer to a potential. The patent discloses a contact brush charging device comprising a plurality of resilient, flexible, thin, partially carbonized polyacrylonitrile fibers arranged in a brush-like configuration. The fibers have an electrical resistivity of from about $10^2$ ohms-cm to about $10^6$ ohms-cm and are substantially resistive to changes in relative humidity and temperature. Again, this patent fails to disclose a polyacrylonitrile wire as an electrical interconnect to replace traditional wire and resistor components.

U.S. Pat. No. 5,139,862 discloses a switch, sensor or two component connector formed from carbonized polyacrylonitrile fibers. Specifically, the patent member having a plurality of small, generally circular cross-section conductive fibers oriented in a polymer matrix in a parallel direction to provide a plurality of potential electrical contacts at the end of the member. These fiber ends contact a second component. The fibers of this patent have a DC volume resistivity of from about $1\times10^{-5}$ to about $1\times10^{10}$ ohms-cm and preferably $1\times10^{-4}$ to about 10 ohms-cm.

U.S. Pat. No. 5,177,529 discloses an electrostatographic printing machine including an electrical connection comprised of two electrical contact elements, one on a mainframe and one on a removable unit. One element comprises a plurality of resiliently flexible conductive fibers arranged in a brush-like configuration. The fibers are partially carbonized polyacrylonitrile having a DC volume resistivity of from about $1\times10^5$ to about $1\times10^{10}$ ohms-cm.

As the above description of the art indicates, polyacrylonitrile fibers are sometimes utilized in xerographic machinery, however, they are not suggested as a replacement to the conventional, metallic wire interconnect utilized in electrostatographic reproduction equipment. Therefore, a need exists for a conductor which replaces metallic wiring and is capable of conducting high voltage while possessing a tailored resistivity. Furthermore, there is a necessity in xerographic reproduction equipment to have an electrical conductor which reduces the radio frequency noise often associated with metallic conductors.

SUMMARY OF THE INVENTION

Accordingly, it is a primary object of this invention to provide a new and improved electrically conductive wire for electrostatographic reproduction machinery.

It is a further object of this invention to provide a new and improved wire capable of conducting a high voltage between power source and corona generating means while limiting current.

A still further object of this invention is to provide a new and improved wire that can conduct a high voltage from a power generating means to a corona generating means without requiring discrete resistors.

Yet another object of this invention is to provide a new and improved wire for use in an electrostatographic printing machine which possesses a tailored resistivity without reliance on discrete resistors.

An additional object of this invention is to provide a new and improved wire for use in electrostatographic reproduction machines which reduces radio frequency noise.

An additional object of this invention is to provide partially carbonized polyacrylonitrile wires for use in electrostatographic reproduction machines which possess tailored resistivities functioning to identify the electrically interconnected components.

Additional objects and advantages of the invention will be set forth in part in the description that follows, and in part will be obvious from the description or may be learned by practice of the invention. The objects and advantages of the invention may be realized and obtained by means of the instrumentalities and combinations particularly pointed out in the appended claims.

To achieve the foregoing objects and in accordance with the purpose of the invention, as embodied and broadly described herein, the wire of this invention comprises an electrically conductive core comprised of a plurality of partially carbonized polyacrylonitrile filaments, each having a resistivity of between about $1\times10^2$ and about $1\times10^{10}$ ohms-cm. The core is surrounded by an electrically insulating jacket.

It is preferred that the core be formed from between about 1,000 and about 18,000 polyacrylonitrile filaments. Preferably, the insulating jacket has a resistivity of at least $10^{13}$ ohms-cm. Preferably, the jacket is formed of an elastomeric or polymeric material. More preferably, the elastomeric material is a silicone while the polymeric material is comprised of a polyester, a polyamide, or polyvinyl chloride.

In one embodiment the wire is utilized as an electrical interconnect between a power source and a scorotron, dicorotron or corotron.

In an alternative embodiment, multiple partially carbonized polyacrylonitrile wires are utilized as conductors between various sites within the machine. These wires are used to distribute power but also act as identifiers of their various sites. Particularly, at least one of the wires is coded with a specific and unique resistance which allows the machine's control center to recognize the location of the site powered by that particular conductive wire having a unique circuit resistance.

BRIEF DESCRIPTION OF THE DRAWINGS

The invention is comprised of the parts, construction, arrangements, combinations and improvements shown and described. The accompanying drawings, which are incorporated in and constitute a part of the specification illustrate one embodiment of the invention and, together with the description, serve to explain the principles of the invention.

Of the drawings.

DETAILED DESCRIPTION OF THE INVENTION

Reference will now be made in detail to a present preferred embodiment of the invention. While the invention will be described in connection with a preferred embodiment. It will be understood that it is not intended to limit the invention to that embodiment. On the contrary, it is intended to cover all alternatives, modifications and equivalents as may be included within the spirit and scope of the invention defined by the appended claims.

Figure 1:
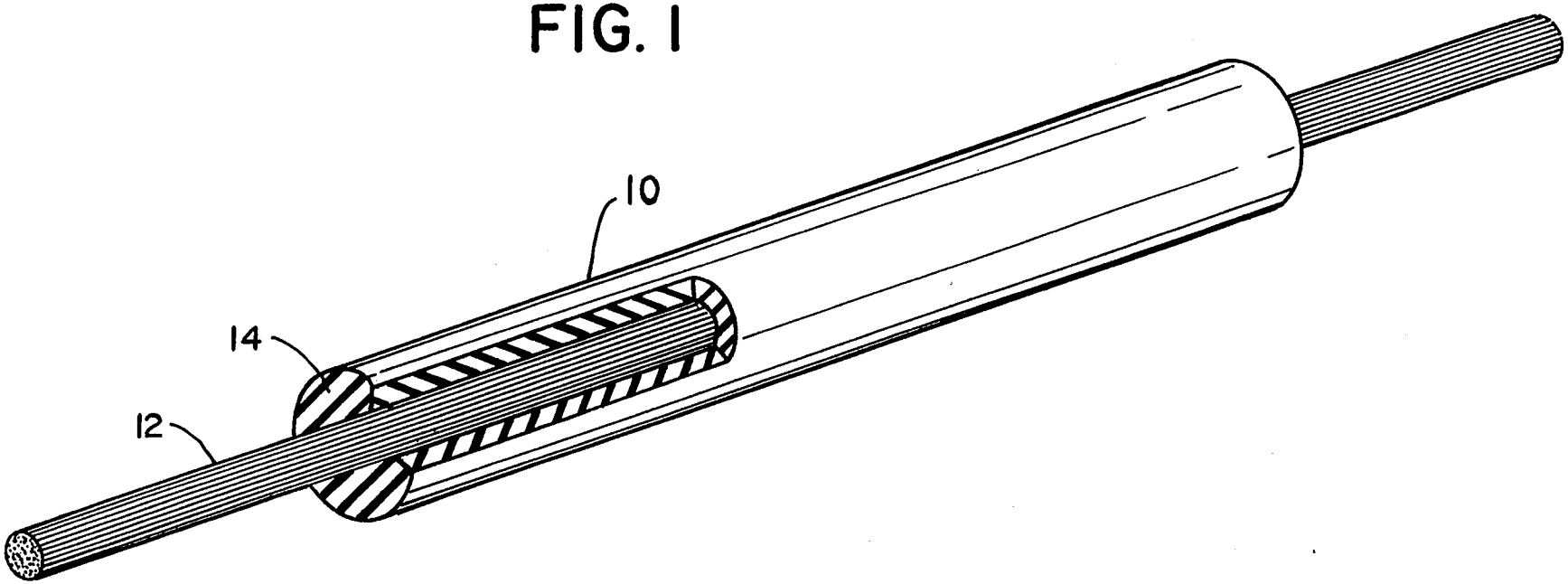
FIG. 1 is a perspective view, partially diagrammatic, showing a typical partially carbonized wire of the invention.

Referring now to FIG. 1, it may be seen that wire 10 of the present invention comprises a plurality of filaments 12. The filaments are comprised of partially carbonized polyacrylonitrile. Sheath 14 encircles the filaments 12 and is generally an insulating dielectric.

Preferred filaments are obtained by a controlled heat treatment process which achieves partial carbonization of polyacrylonitrile precursor fibers. Thereafter, the fibers are preferably combined to form a tow. Continuous lengths of the fiber tow are pulled through a polymer resin bath or impregnator and then into a preforming fixture wherein the tow is partially shaped and excess resin and/or air is removed. The tow is then pulled through heated dies and, when the polymeric sheath is thermosetting, continuously cured.

The fibers are generally circular in cross section and have a diameter from about 5 to about 50 microns and preferably from about 8 to about 10 microns. The wire comprises thousands of conductive fiber elements contained within the polymer matrix. The ends of the wire comprise polyacrylonitrile fibers whose surfaces provide excellent electric contact points. The wire comprises fibers continuous from one end to the other and oriented within the resin matrix in a direction substantially parallel to the axial direction of the wire. The term "axial direction" is intended to define a lengthwise or longitudinal direction, i.e. along the major axis.

Typically, the polymer coating is selected from the group of thermoplastic and thermosetting resins. Polyesters, poly-etherketones, silicones, polyvinyl chlorides and nylon are suitable materials. The silicones are preferred due to their short cure time, relative chemical inertness, good flexibility, and high resistance. An elastomeric matrix may be a silicone, a fluoro-silicone or polyurethane elastomer. Preferably, the nonconductive jacket is an elastomeric silicone, which is co-extruded with the tow core to provide a structure in which the filaments are embedded in the surrounding matrix. However, it should be apparent to one of ordinary skill in the art that any type of non-conductive material can be used for the jacket. U.S. Pat. Nos. 4,761,709 and 5,139,862, which describe preferred coatings are herein incorporated by reference.

It has been found that for polyacrylonitrile fibers, carefully controlling the temperature of carbonization yields precise resistivities for the carbonized or partially carbonized polyacrylonitrile fibers. Table 1 provides general examples of the effect of carbonizing temperature on resistivity of the PAN fibers.

TABLE 1

| Example | Carbonizing Temp | Resistivity Ohm/cm |
|---|---|---|
| 1 | 382° C. | $1.5\times10^{11}$ |
| 2 | 421° C. | $1.5\times10^{9}$ |
| 3 | 493° C. | $7.4\times10^{7}$ |

TABLE 1-continued

| Example | Carbonizing Temp | Resistivity Ohm/cm |
|---|---|---|
| 4 | 549° C. | $4.0 \times 10^6$ |
| 5 | 610° C. | $7.4 \times 10^4$ |
| 6 | 654° C. | $1.8 \times 10^3$ |

Polyacrylonitrile fibers are commercially produced and available from B.A.S.F., Amoco, Hercules, Toho and Toray in Japan.

Typically, the yarn bundles or tow obtained from suppliers are partially carbonized in a two-stage process involving stabilizing the polyacrylonitrile fibers at temperatures of approximately 300° C. to produce a preoxidized polyacrylonitrile fiber followed by carbonization at elevated temperatures in an inert (ex. nitrogen) atmosphere. The DC volume resistivity of the resulting fibers is primarily controlled by the selection of the temperature of carbonization. For example, carbon fibers having an electrical resistivity of from about $10^2$ to about $10^6$ ohms-cm, i.e. those preferred in the current invention, are obtained if the carbonization temperature is in a range of about 500° C. to 750° C.

An additional advantage of the current invention is the high modulus of the fibers, for example, 20 million to 60 million psi. Accordingly, the PAN wire can also serve a structural function if desired. A structural polymer particularly improves the structural characteristics of the wire. Typically, the fibers experience tensile elongation of from about 1 to about 5 percent of their initial length before they fracture. Preferably, the PAN wire will undergo tensile elongation of greater than 2 percent and preferably between 3 and 5 percent before fracturing.

Figure 2:
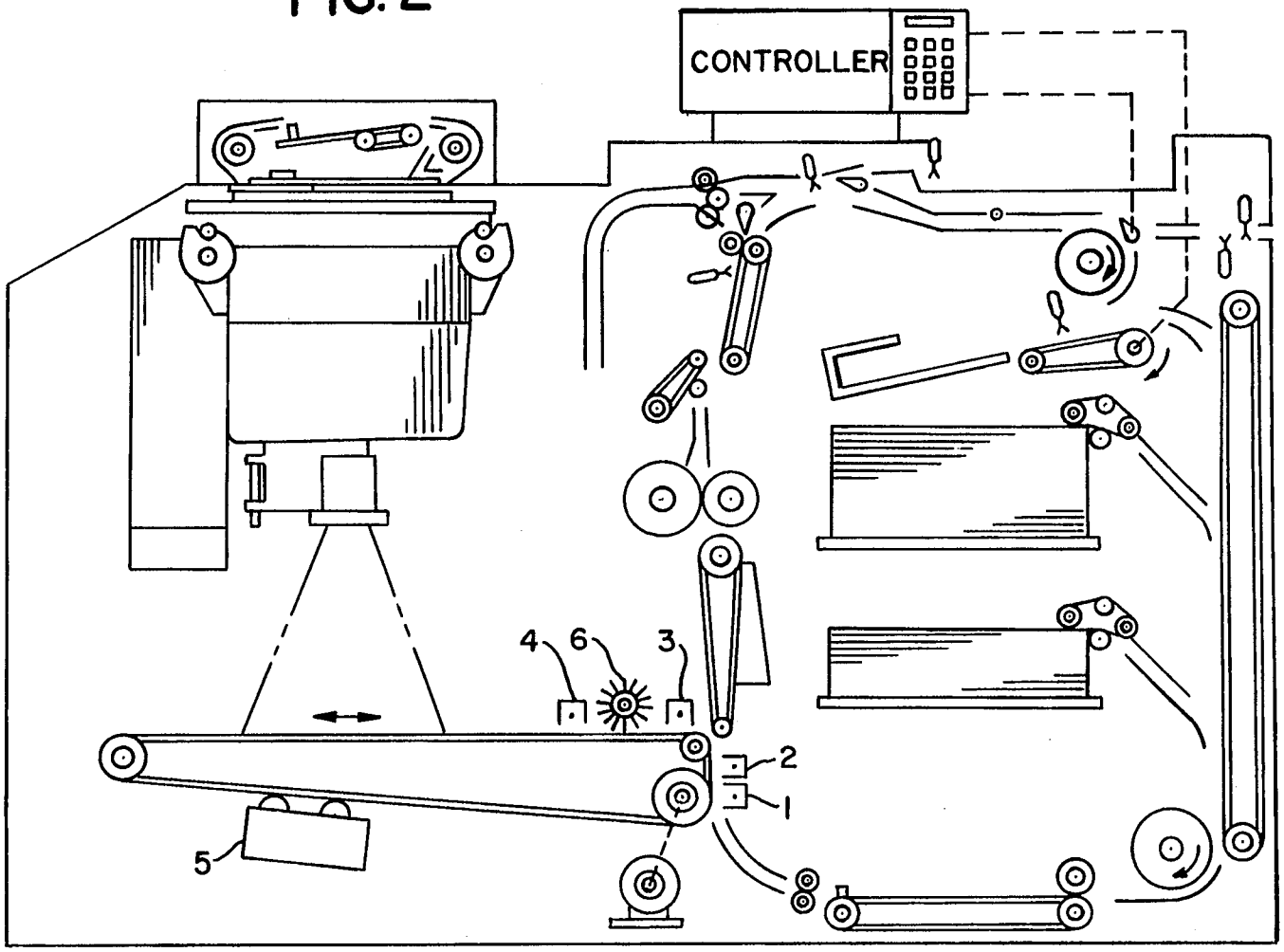
FIG. 2 is a schematic representation of an electrostatographic reproduction machine in which the wire of the present invention may be used.

Referring now to FIG. 2, a electrostatographic reproduction machine is shown. FIG. 2 at points 1, 2, 3, 4, 5 and 6 illustrates the location within a machine at which the currently claimed conductive partially carbonized fiber core wires are particularly connected. Preferably connection is accomplished by mechanical crimping or a combination crimping and conductive adhesive.

The fibers of the invention are also suited for use as a means to identify machine components. Particularly, xerographic processes require several coordinated and interactive steps to function. For example, charging, imaging, exposing, developing, transferring, fusing and cleaning each form a critical stage in the process. Each of these stages is timed to the others and the machine's microprocessor is responsible for efficient interaction.

In an alternative embodiment of the current invention, PAN wires as conductors from microprocessor to each stage can act as identifiers of the stage to the microprocessor. More particularly, the microprocessor identifies the stage by the resistance of the specific PAN wire connection. This feature is believed to be particularly effective as a diagnostic tool.

Thus, it is apparent that there has been provided, in accordance with the invention, a conductive wire that fully satisfies the aims, objects and advantages set forth above. While the invention has been described in conjunction with the specific embodiments thereof, it is evident that many alternatives, modifications, and variations will be apparent for those skilled in the art in light of the forgoing description. Accordingly, it is intended to embrace all such alternatives, modifications and variations as fall within the spirit and broad scope of the appended claims.

Having thus described the invention, it is claimed:

1. A composite electrically conductive wire for use in electrostatographic reproducing machines comprising an electrically conductive core comprising a plurality of partially carbonized polyacrylonitrile filaments having a resistivity of between about $1\times10^2$ and about $1\times10^{10}$ ohms-cm and an electrically insulating jacket surrounding said filaments.

2. The wire of claim 1 having a resistivity of between about $1\times10^3$ and about $1\times10^6$ ohms-cm.

3. The wire of claim 1 further comprising an electrical connection between a power source and a scorotron.

4. The wire of claim 1 further comprising an electrical connection between a power source and a dicorotron.

5. The wire of claim 1 further comprising an electrical connection between a power source and a corotron.

6. The wire of claim 1 wherein said core is comprised of from about 2,000 to about 50,000 filaments.

7. The wire of claim 6 wherein said core is comprised of from about 3,000 to about 18,000 filaments.

8. The wire of claim 1 wherein said jacket is comprised of an insulating elastomeric material.

9. The wire of claim 1 wherein said jacket is comprised of an insulating polymeric material.

10. The wire of claim 8 wherein said elastomeric material comprises silicone.

11. The wire of claim 9 wherein said polymeric material comprises a polyester.

12. The wire of claim 9 wherein said polymeric material comprises polyvinyl chloride.

13. The wire of claim 1 wherein said filaments can be elongated under a tensile strength from greater than about 2% before they fracture.

14. The wire of claim 1 wherein said filaments can be elongated under a tensile strength from between about 3% to about 5% before they fracture.

15. The wire of claim 1 wherein said core has a diameter of from about 5 microns to about 50 microns.

16. The wire of claim 15 wherein said core has a diameter of from about 8 microns to about 10 microns.

17. The wire of claim 1 being flexible.

18. An electrostatographic reproduction machine including at least one electrical interconnect between a power source and an electrostatic field generating means, said interconnect comprising a wire having a partially carbonized polyacrylonitrile core and an electrically insulating jacket.

19. The machine of claim 18 wherein said wire has a resistivity of between about $1\times10^2$ and about $1\times10^{10}$ ohms-cm.

20. The machine of claim 19 wherein said wire has a resistivity of between about $1\times10^3$ and about $1\times10^6$ ohms-cm.

21. An electrostatographic reproduction machine comprising a plurality of electrical components requiring the supply of electric current, said machine including a plurality of partially carbonized polyacrylonitrile wires connecting said electrical components to a microprocessor, at least two of said wires having distinct resistivities.

* * * * *